United States Patent [19]

Kato

[11] Patent Number: 4,735,187

[45] Date of Patent: Apr. 5, 1988

[54] IGNITION SYSTEM FOR INTERNAL COMBUSTION ENGINES

[75] Inventor: Kouichi Kato, Kariya, Japan

[73] Assignee: Nippondenso Co., Ltd., Kariya, Japan

[21] Appl. No.: 20,857

[22] Filed: Mar. 2, 1987

[30] Foreign Application Priority Data

Mar. 3, 1986 [JP] Japan ..... 61-46750

[51] Int. Cl.[4] ..... F02P 3/04

[52] U.S. Cl. ..... 123/651; 123/198 DB; 123/644; 123/198 DC

[58] Field of Search ..... 123/651, 198 DB, 198 DC, 123/644, 643, 629

[56] References Cited

U.S. PATENT DOCUMENTS 4,099,495 7/1978 Kiencke et al. ..... 123/198 DC
4,117,807 10/1978 Barnard ..... 123/198 DB
4,201,173 5/1980 Okada et al. ..... 123/651
4,380,989 4/1983 Takaki ..... 123/644
4,408,592 10/1983 Yoshinaga et al. ..... 123/651
4,660,534 4/1987 Catiaroli ..... 123/651

*Primary Examiner*—Raymond A. Nelli
*Attorney, Agent, or Firm*—Cushman, Darby & Cushman

[57] ABSTRACT

In an ignition system for an internal combustion engine, on-off signals each responsive to one of a plurality of ignition signals from an engine control unit to switch on and off the primary current in an ignition coil are detected. A first trigger signal is produced from the logical sum of the detection signals and a second trigger signal is produced from the logical sum of the plurality of ignition signals from the engine control unit. A single nonretriggerable monostable multivibrator receives the first and second trigger signals to generate an engine ignition monitor signal.

4 Claims, 3 Drawing Sheets

IGNITION SYSTEM FOR INTERNAL COMBUSTION ENGINES

BACKGROUND OF THE INVENTION

1. Field of the Invention

The present invention relates to an ignition system for internal combustion engines installed mainly on automotive vehicles.

2. Description of the Prior Art

Ignition systems are known in the art in which in response to one of a plurality of ignition signals from an engine control unit each of a plurality of power transistors is turned on and off to switch on and off the primary current flow in an ignition coil. In one such ignition system (e.g., Journal of Nippondenso Technical Disclosure, Reference Number 37-063), the output operating state of each of a plurality of power transistors is detected to trigger a monostable multivibrator and the OR operation is performed on the outputs of the monostable multivibrators to apply an ignition monitor signal to the engine control unit.

However, the conventional ignition system of this type requires a monostable multivibrator for each power transistor and therefore there is the disadvantage of complicating the circuit construction and increasing the cost. Also, the monostable multivibrator generally uses a capacitor and the fabrication of such monostable multivibrators in a monolithic IC requires that their capacitors are externally connected to the bumps projected from the IC. Thus, this system is disadvantageous from the standpoint of reliability in that an increase in the number of monostable multivibrators increases the number of bumps on a monolithic IC and the number of capacitors.

SUMMARY OF THE INVENTION

With a view to overcoming the foregoing deficiencies in the prior art, it is an object of the present invention to provide an ignition system for internal combustion engines which employs only a single ignition monitoring monostable multivibrator with the resulting improvement in reliability.

To accomplish the above object, in accordance with the invention there is thus provided an ignition system for internal combustion engines including a plurality of power transistors each adapted to be turned on and off to switch on and off the primary current in an ignition coil in response to one of a plurality of driver circuits which are each operated by an ignition signal applied from an engine control unit, a logic circuit for performing the logic operation on the output operating states of the power transistors, and a nonretriggerable monostable multivibrator for receiving as a trigger signal the ignition signal applied to each of the driver circuits and also receiving as a trigger signal the output of the logic circuit such that an ignition monitor signal of a given time width is applied to the engine control unit in response to the application of the two trigger signals.

By virtue of this construction, the ignition signal applied to each of the driver circuits is applied as a trigger signal to the single nonretriggerable monostable multivibrator and moreover the logic circuit performs the logic operation on the output operating states of the power transistors. When the output of the logic circuit is applied as a trigger signal to the nonretriggerable monostable multivibrator, the nonretriggerable monostable multivibrator generates an ignition monitor signal. Thus, the operating states of the power transistors are monitored accurately by the single nonretriggerable monostable multivibrator.

DESCRIPTION OF THE PREFERRED EMBODIMENTS

Figure 1:
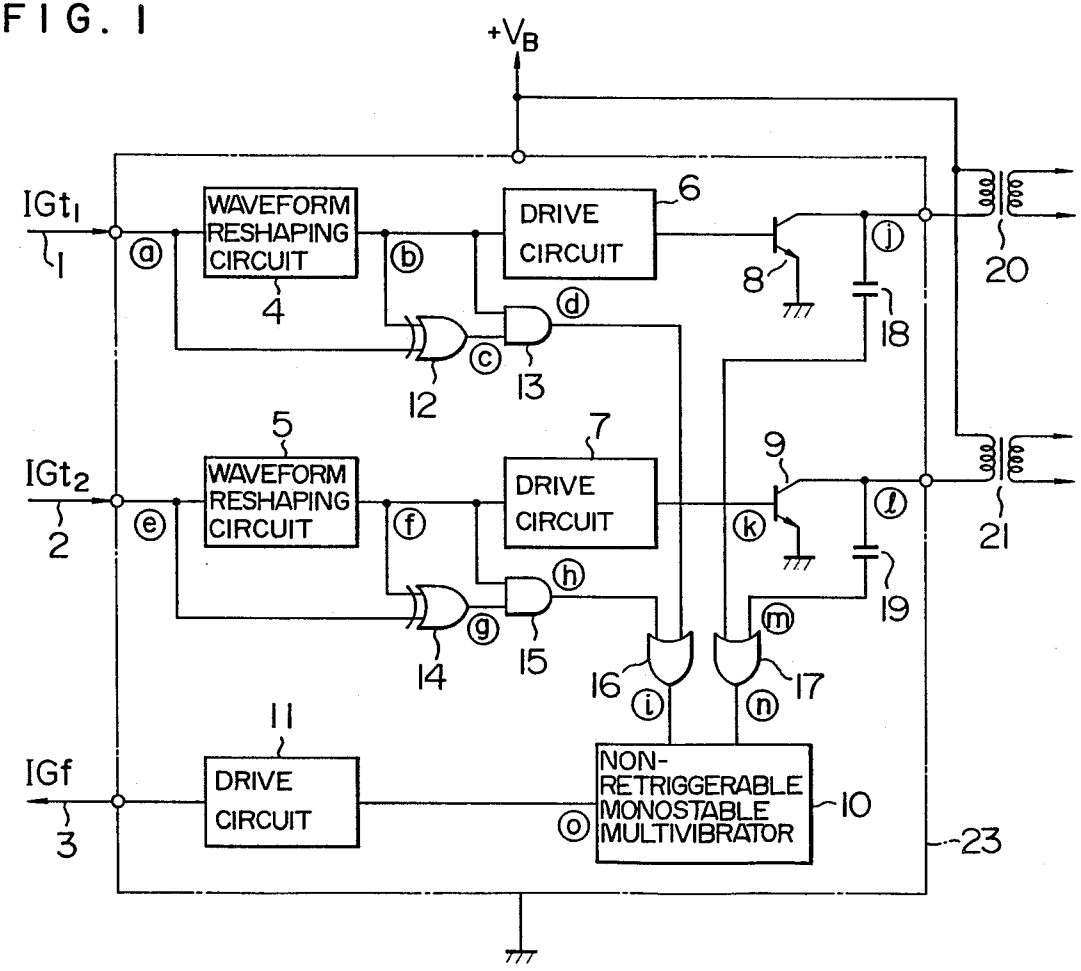
FIG. 1 is an electric circuit diagram showing an embodiment of an ignition system according to the invention.

The present invention will now be described in greater detail with reference to the illustrated embodiment. In FIG. 1 illustrating the embodiment of the ignition system according to the invention, numerals 1 and 2 designate connection wires for receiving ignition signals $IGt_1$ and $IGt_2$, respectively, 3 a connection wire for generating an ignition monitor signal $IG_f$, and 4 and 5 waveform reshaping circuits for reshaping the ignition signals $IGt_1$ and $IGt_2$, respectively. Numerals 6 and 7 driver circuits which are respectively operated by the rectangular outputs of the waveform reshaping circuits 4 and 5, and 8 and 9 power transistors which are respectively turned on and off by the driver circuits 6 and 7 to switch on and off the primary current flow in ignition coils 20 and 21, respectively. Numeral 10 designates a nonretriggerable monostable multivibrator for generating the ignition monitor signal $IG_f$, and 11 a driver circuit for amplifying the ignition monitor signal $IG_f$. Numerals 12 and 14 designate exclusive OR circuits for performing the exclusive OR operation on the input and output of the waveform reshaping circuits 4 and 5, 13 and 15 AND circuits for respectively performing the AND operation on the outputs of the waveform reshaping circuit 4 and the exclusive OR circuit 12 and the outputs of the waveform reshaping circuit 5 and the exclusive OR circuit 14, and 16 and 17 OR circuits for respectively performing the OR operation on the outputs of the AND circuits 13 and 15 and on the collector outputs of the power transistors 8 and 9 such that the outputs of these OR circuits are applied as trigger inputs to the nonretriggerable monostable multivibrator 10. Numerals 18 and 19 designate capacitors connected respectively between one of the inputs of the OR circuit 17 and the collector of the power transistor 8 and between the other input of the OR circuit 17 and the collector of the power transistor 9 so as to cut off the collector voltages of the power transistors 8 and 9 in the form of dc voltages.

Figure 2:
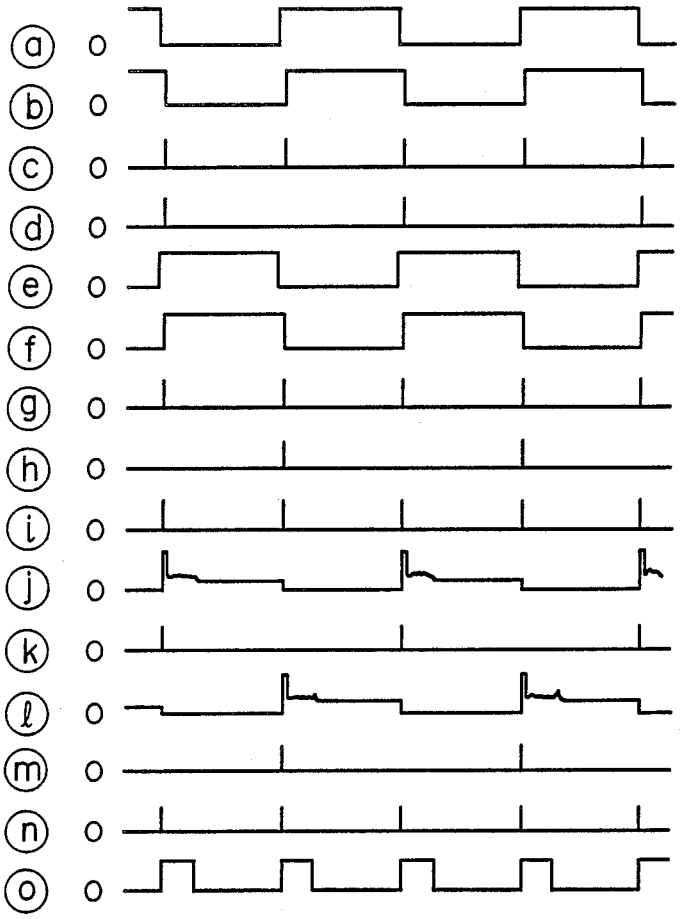
FIG. 2 illustrates a plurality of signal waveforms useful for explaining the operation of the ignition system shown in FIG. 1.

FIG. 2 shows the voltage waveforms generated at points a to o in the circuit diagram of FIG. 1.

Figure 3:
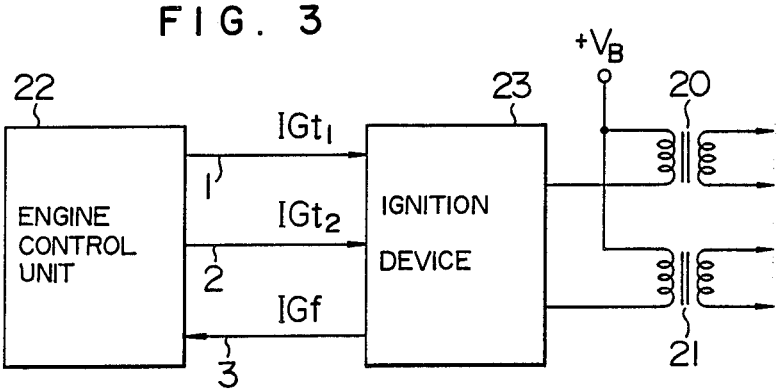
FIG. 3 is a block diagram showing the overall construction of the invention.

FIG. 3 is a block diagram showing the basic construction of the invention as a whole. In the Figure, numeral 22 designates an engine control unit (ECU) for controlling the quantity of fuel supplied to the engine, the ignition timing, etc., in accordance with various factors such as the speed, intake air flow and cooling water temperature of the engine, and 23 an ignition device for receiving the input ignition signals from the ECU 22 to supply the ignition signals to the ignition coils 20 and 21. Numerals 1, 2 and 3 designate the previously mentioned connecting wires for interconnecting the ECU 22 and the ignition device 23, and $IGt_1$, $IGt_2$ and $IG_f$ the signals generated on the connecting wires 1, 2 and 3, respectively. In other words, designated at $IG_f$ is the ignition monitor signal for informing the ECU 22 of a fault in the ignition device 23, and $IGt_1$ and $IGt_2$ the ignition signals for determining the times of ignition.

The operation of the ignition device 23 forming the principal part of the ignition system of this invention will now be described with reference to the waveform diagram of FIG. 2. The waveform a shows the waveform of the ignition signal $IGt_1$ generated on the connecting wire 1 by the ECU 22 and the waveform a is passed through the waveform reshaping circuit 4 thereby delaying it by a very small time as shown by the waveform b. This differential delay is utilized to apply the waveforms a and b to the exclusive OR circuit 12 which in turn generates a waveform c. Then, the waveforms c and b are applied to the AND circuit 13 thereby generating a waveform d. The waveform d is a trigger pulse signal generated just prior to the transition from the turning-on to the turning-off of the power transistor 8.

In the like manner, waveforms f, g and h are produced from the input ignition signal $IGt_2$ (waveform e) applied through the connecting wire 2. The waveform h is a trigger pulse signal generated just prior to the transition from the turning-on to the turning-off of the power transistor 9. Then, the OR circuit 16 produces a waveform i from the waveforms d and h.

On the other hand, the power transistor 8 is turned on and off by the waveform b amplified by the driver circuit 6 to produce a high voltage in the secondary winding of the ignition coil 20 in response to the transition from the turning-on to the turning-off of the power transistor 8. At this time, a voltage of several hundreds volts is applied as shown at a waveform j to the collector of the power transistor 8 connected to the primary winding of the ignition coil 20. The waveform j is clamped at a given level to produce a waveform k. In the like manner, a waveform m is produced from the collector waveform l of the power transistor 9 and a waveform n is produced from the waveforms k and m by the OR circuit 17. The waveform n is a signal informing the production of a high voltage in the secondary winding of the ignition coil 20 or 21.

Figure 4:
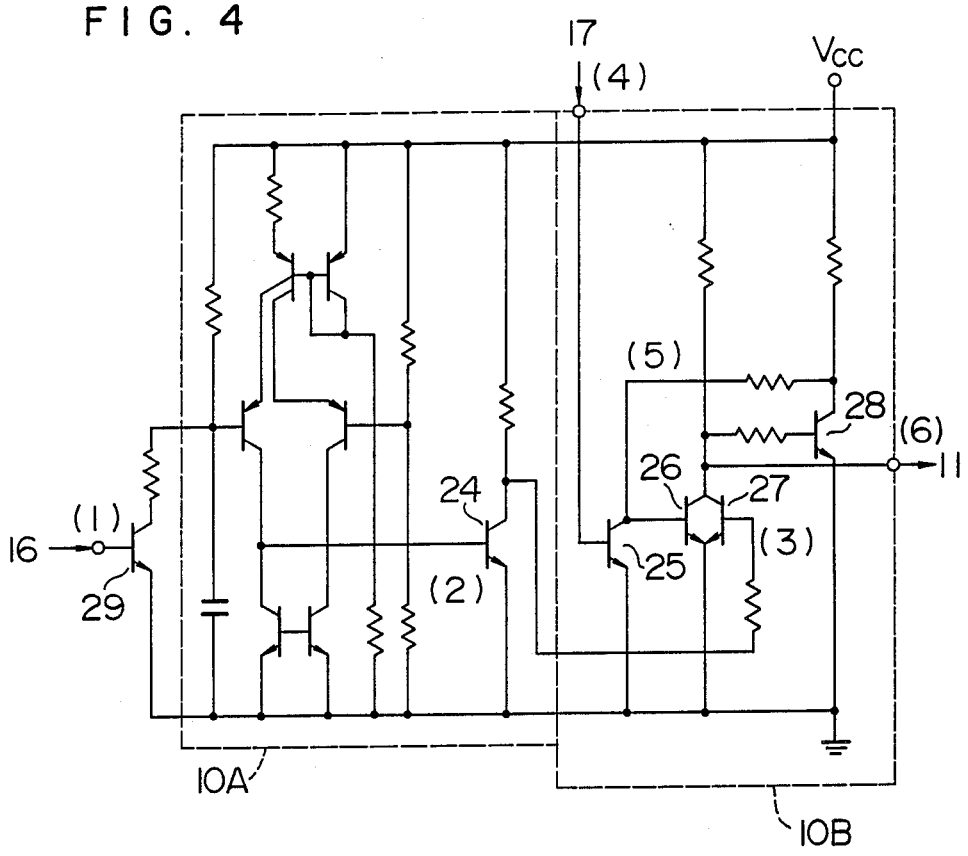
FIG. 4 is a detailed circuit diagram of the nonretriggerable monostable multivibrator in the ignition system shown in FIG. 1.
Figure 5:
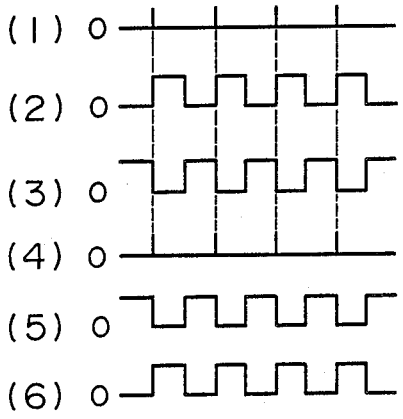
FIG. 5 illustrates a plurality of signal waveforms useful for explaining the operation of the circuit shown in FIG. 4.

FIG. 4 shows a detailed internal circuit of the nonretriggerable monostable multivibrator 10. The operation of the nonretriggerable monostable multivibrator 10 will now be described with reference to the circuit diagram of FIG. 4 and the waveform diagram of FIG. 5. When a waveform (1) indicative of a point just before the ignition timing is applied from the OR circuit 16 to the base of a transistor 29, a pulse of a constant time width or a waveform (2) is generated from a monostable circuit 10A and applied to the base of a transistor 24. An inverted waveform (3) of the waveform (2) is applied to the base of a transistor 27. On the other hand, a waveform (4) indicating the production of a high voltage in the ignition coil 20 or 21 is applied to the base of a transistor 25 so that the transistor 25 is turned on and a transistor 26 is turned off. Since the transistor 27 is off at this time, a transistor 28 is turned on so that the base potential of the transistor 26 is decreased. As a result, the transistor 26 is also maintained off as long as the transistor 27 is off. At this time, an $IG_f$ output or waveform (6) generated from the collectors of the transistors 26 and 27 goes to a high level. Then, when the transistor 27 is turned on, the $IG_f$ output or waveform (6) goes to a low level. In other words, in FIG. 4 a trigger circuit 10B is designed so that the application of the waveform (4) or the trigger signal causes the output waveform (6) to go to the high level when the pulse waveform (2) is at the high level and to go to the low level when the pulse waveform (2) is at the low level. At this time, the output waveform (6) remains unchanged even if a plurality of waveforms (4) or trigger signals are applied. Thus, a retriggering preventive monostable multivibrator is constructed. The waveform (6) thus generated is amplified by the driver 11 and the resulting amplified ignition monitor signal $IG_f$ is applied to the ECU 22.

In accordance with this embodiment, the monostable circuit 10A is triggered by each of the ignition signals in synchronism with the ignition timing so that the power transistor 8 or 9 is turned on at the ignition timing. When this occurs, the trigger circuit 10B is triggered by the voltage induced at the collector of the power transistor 8 or 9 and the monostable output of the monostable circuit 10A is outputted as an ignition monitor signal. Thus, even if a noise voltage is induced at the collector of the power transistor 8 or 9 upon spark discharge thus causing the OR circuit 17 to generate a noise output, the trigger circuit 10B is not triggered again and only the monostable output generated from the monostable circuit 10A in synchronism with the ignition timing is stably outputted as the ignition monitor signal.

While, in the above-described embodiment, the invention is embodied in an ignition system including two ignition coils which are each operated by an input ignition signal, the invention is equally applicable to an ignition system including three or more ignition coils which are each operated by an input ignition signal. In addition, the effect of the invention is enhanced as the number of input ignition signals and the number of ignition coils are increased. Also, the invention is applicable to an ignition system in which a single ignition coil has two primary windings and the current in the primary windings are alternately switched on and off by two power transistors.

Also, in the above-described embodiment, trigger signals each synchronized with the trailing edge of each ignition signal are generated through the exclusive OR circuits 12 and 14 and the AND circuits 13 and 15. Another available method of generating a trigger signal synchronized with the trailing edge of each ignition signal would be to generate a trigger signal in synchronism with the trailing edge of each ignition signal by the use of a differentiating circuit or the like. Also, where the monostable circuit 10A is of the type which is triggered in synchronism with the leading or trailing edge of an input signal, it is possible to perform the OR operation on the ignition signals or the outputs of the waveform reshaping circuits 4 and 5 to directly apply the resulting output as a trigger signal to the monostable circuit 10A.

Further, while, in the above-described embodiment, the collector voltages of the power transistors 8 and 9 are detected to monitor the operating states of the power transistors 8 and 9, it is possible to detect the currents flowing in the power transistors 8 and 9 to monitor their operating states.

From the foregoing description it will be seen that in accordance with the invention the operating states of a plurality of power transistors can be monitored by a single nonretriggerable monostable multivibrator with the resulting effect of simplifying the circuit construction and reducing the cost. Further, even if the spark discharge causes noise in the circuit for producing a trigger signal from the output waveform of each power transistor, the noise is synchronized with a trigger signal produced from the ignition signal thereby preventing the danger of an ignition monitor signal from being generated erroneously.

I claim:

1. An ignition system for an internal combustion engine comprising:

a plurality of driver circuits each operable in response to an ignition signal from an engine control unit;

a plurality of power transistors each responsive to one of said driver circuits to switch on and off a primary current in an ignition coil;

a logic circuit for performing a logic operation on output operating states of said power . transistors; and nonretriggerable monostable multivibrator means for receiving the ignition signal applied to each of said driver circuits as a first trigger signal and an output of said logic circuit as a second trigger signal whereby an ignition monitor signal having a predetermined time width is applied to said engine control unit when said first and second trigger signals are received.

2. An ignition system according to claim 1 wherein said nonretriggerable monostable multivibrator means comprises:

a monostable multivibrator for receiving the ignition signal applied to each of said driver circuits as a first trigger signal to generate a monostable output having a predetermined time width at an ignition timing; and a trigger circuit for receiving the monostable output of said monostable multivibrator and the output of said logic circuit whereby when the output of said logic circuit is generated simultaneously with the generation of the monostable output from said monostable multivibrator, said trigger circuit is triggered by the output of said logic circuit to output the monostable output of said monostable multivibrator as said ignition monitor signal.

3. An ignition system for an internal combustion engine comprising:

a first waveform reshaping circuit for receiving a first ignition signal from an engine control unit;

a first driver circuit for receiving a first reshaped signal from said first waveform reshaping circuit;

a first power transistor responsive to a driving signal from said first driver circuit to switch on and off a primary current in a first ignition coil;

a second waveform reshaping circuit for receiving a second ignition signal from said engine control unit;

a second driver circuit for receiving a second reshaped signal from said second waveform reshaping circuit;

a second power transistor responsive to a driving signal from said second driver circuit to switch on and off a primary current in a second ignition coil;

a first OR circuit for receiving a power signal from each of said first and second power transistors;

a first exclusive OR circuit for receiving said first ignition signal and said first reshaped signal;

a first AND circuit for receiving said first reshaped signal and a logic output signal of said first exclusive OR circuit;

a second exclusive OR circuit for receiving said second ignition signal and said second reshaped signal;

a second AND circuit for receiving said second reshaped signal and a logic output signal of said second exclusive OR circuit;

a second OR circuit for receiving a logic output signal from each of said first and second AND circuits;

single nonretriggerable monostable multivibrator means for receiving a logic output signal serving as a trigger signal from each of said first and second OR circuits; and a third driver circuit for amplifying an ignition monitor signal of a predetermined time width applied from said monostable multivibrator means to apply the same to said engine control unit.

4. An ignition system according to claim 3 wherein said nonretriggerable monostable multivibrator means comprises:

a monostable multivibrator for receiving the logical sum output serving as a trigger signal from said second OR circuit to generate a monostable signal having a predetermined time width; and a trigger circuit whereby when the monostable signal from said monostable multivibrator and the logical sum output serving as a trigger signal from said first OR circuit are received simultaneously and when the same are both at a high level, said ignition monitor signal is generated and thereafter maintained constant even when a plurality of trigger signals are received from said first OR circuit.

* * * * *